US006630664B1

(12) United States Patent
Syage et al.

(10) Patent No.: US 6,630,664 B1
(45) Date of Patent: Oct. 7, 2003

(54) ATMOSPHERIC PRESSURE PHOTOIONIZER FOR MASS SPECTROMETRY

(75) Inventors: Jack A. Syage, Huntington Beach, CA (US); Karl A. Hanold, Irvine, CA (US); Matthew D. Evans, Irvine, CA (US); Yong Liu, Fountain Valley, CA (US)

(73) Assignee: Syagen Technology, Tustin, CA (US)

( * ) Notice: Subject to any disclaimer, the term of this patent is extended or adjusted under 35 U.S.C. 154(b) by 0 days.

(21) Appl. No.: 09/596,307

(22) Filed: Jun. 14, 2000

Related U.S. Application Data

(63) Continuation-in-part of application No. 09/247,646, filed on Feb. 9, 1999.

(51) Int. Cl.[7] ..... H01J 49/10; H01J 27/24

(52) U.S. Cl. ..... 250/288; 250/423 P; 250/382

(58) Field of Search ..... 250/288, 423 P, 250/379, 382

(56) References Cited

U.S. PATENT DOCUMENTS

| | | | | |
|---|---|---|---|---|
| 3,555,272 A | | 1/1971 | Munson et al. | |
| 4,239,967 A | * | 12/1980 | Carr et al. | 250/288 |
| 4,365,157 A | | 12/1982 | Unsöld et al. | |
| 4,433,241 A | * | 2/1984 | Boesl et al. | 250/423 P |
| 4,531,056 A | * | 7/1985 | Labowsky et al. | 250/288 |
| 4,540,884 A | | 9/1985 | Stafford et al. | |
| 4,733,073 A | | 3/1988 | Becker et al. | |
| 4,780,608 A | | 10/1988 | Cross et al. | |
| 4,804,846 A | * | 2/1989 | Hall | 250/288 |
| 4,849,628 A | | 7/1989 | McKuckey et al. | |
| 4,855,594 A | | 8/1989 | Kimock et al. | |
| 4,861,988 A | | 8/1989 | Henion et al. | |
| 4,931,640 A | | 6/1990 | Marshall et al. | |
| 4,982,097 A | * | 1/1991 | Slivon et al. | 250/288 |
| 5,032,721 A | | 7/1991 | Bacon et al. | |
| 5,070,240 A | * | 12/1991 | Lee et al. | |
| 5,153,672 A | * | 10/1992 | Globig et al. | 250/423 P |
| 5,206,594 A | | 4/1993 | Zipf | |
| 5,234,838 A | | 8/1993 | Bacon, Jr. | |
| 5,283,436 A | | 2/1994 | Wang | |
| 5,294,797 A | | 3/1994 | Frey et al. | |
| 5,311,016 A | | 5/1994 | Villa-Aleman | |
| 5,338,931 A | * | 8/1994 | Spangler et al. | 250/287 |
| 5,343,488 A | * | 8/1994 | Guyot et al. | 372/53 |
| 5,381,006 A | | 1/1995 | Wells et al. | |
| 5,393,979 A | | 2/1995 | Hsi | |
| 5,397,895 A | | 3/1995 | Leone et al. | |
| 5,412,207 A | | 5/1995 | Micco et al. | |
| 5,469,323 A | | 11/1995 | Kanayama | |
| 5,504,328 A | | 4/1996 | Bonser | |
| 5,527,731 A | | 6/1996 | Yamamoto et al. | |

(List continued on next page.)

FOREIGN PATENT DOCUMENTS

WO WO 01/33605 A2 * 5/2001

OTHER PUBLICATIONS

Revel'skii et al., Mass Spectrometry With Photoionization at Atmospheric Pressure and the Analysis of Multicomponent Mixtures Without Separation, Chemical and Physicochemical Methods of Analysis, 1991, Plenum Publishing Corporation, pp. 243–248.*

(List continued on next page.)

*Primary Examiner*—Jack Berman
(74) *Attorney, Agent, or Firm*—Irell & Manella LLP

(57) ABSTRACT

A monitor that can detect a trace molecule that is ionized at approximately one atmosphere. The molecule is ionized with a photoionizer and detected by a detector. The monitor may include a number of techniques to introduce a sample into the photoionizer at approximately one atmosphere. One technique includes creating an electrically charged spray that is directed into the ionizer. The photoionizer may include a plurality of light sources that each ionize the sample with a different radiation energy.

30 Claims, 10 Drawing Sheets

U.S. PATENT DOCUMENTS

| | | | | |
|---|---|---|---|---|
| 5,554,846 | A | | 9/1996 | Regiec et al. |
| 5,569,917 | A | | 10/1996 | Buttrill, Jr. et al. |
| 5,631,462 | A | | 5/1997 | Reentz, Jr. |
| 5,808,299 | A | | 9/1998 | Syage |
| 5,826,214 | A | * | 10/1998 | Lieb et al. ..... 702/22 |
| 5,854,431 | A | | 12/1998 | Linker et al. |
| 5,869,832 | A | | 2/1999 | Wang et al. |
| 5,906,946 | A | * | 5/1999 | Sausa et al. ..... 250/282 |
| 6,011,259 | A | | 1/2000 | Whitehouse et al. |
| 6,040,575 | A | | 3/2000 | Whitehouse et al. |
| 6,140,638 | A | | 10/2000 | Tanner et al. |

OTHER PUBLICATIONS

"Tunable VUV Radiation Generated by Two–Photon Resonant Frequency Mixing in Zenon," IEEE Journal of Quantum Electronics, vol. QE–19, No. 2, Feb. 1983.

"Real–Time Detection of Chemical Agents Using Molecular Beam Laser Mass Spectrometry," Jack A. Syage, Aerophysics Laboratory, Reprinted from Analytical Chemistry, 1990, 62.

"New Developments in Molecular Detection by Supersonic Moecular Beam, Laser Mass Spectrometry," Jack A. Syage, pp. 469–489.

"Cyclic Ketone Mixture Analysis Using 2 + 1 Resonance–Enhanced Multiphoton Ionization Mass Spectrometry, " Dale R. Nesselrodt et al., Anal. Chem. 1994, 66, 2497–2504.

"Pulsed Laser Desorption of Biological Molecules in Supersonic Beam Mass Spectrometry W/Resonant Two–Photon Ionization Detection," R. Tembreull, Anal. Chem. 1987, 59, 1082–1088.

"A Hybrid Instrument that Combines TOF With the Ion Trap Yields Excellent Sensitivity for Small Samples," Anal. Chem. vol. 67, No. 7, Apr. 1, 1995.

"An Ion Trap Storage/Time–of–Flight Mass Spectrometer," S.M. Michael et al., Rev. Sci. Instrum. 63 (10), Oct. 1992, pp. 4277–4284.

"Third–Harmonic Generation in Argon, Krypton, & Xenon: Bandwidth Limitations in the Vicinity of Lyman–a," R. Mahon IEEE Journal of Quantum Electronics, vol. QE–15, No. 6, 6/79.

Pulsed Free Jets: Novel Nonlinear Media for Generation of Vacuum Ultraviolet and Extreme Ultraviolet Radiation,: J. Phys. Chem. 1984, 88,4459–4465.

"Compact Vacuum Ultraviolet Source for Photoelectron Spectroscopy," Rev. Sci. Instrum. 60(7), Jul. 1989.

"Generation of Narrowband Tunable VUV Radiation at the Lyman–a Wavelength," Optics Communications, vol. 33, No. 1, Apr. 1980.

R. Frey, et al. "Real–Time Vehicle Exhaust Analysis Using a Laser TOF Mass Spectrometer" Proc. 40$t^h$ Anal. Conf. Mass Spectrom & Allied Topics, 1992, pp 678–679.

E.R. Rohwer, R.C. Beavis,C. Koster, J. Lindner, J. Grotemeyer and E.W. Schlag, "Fast Pulsed Laser Induced Electron Generation for Electron Impact Mass Spectrometry", Nov. 23, 1988, pp. 1151–1153.

J.G. Boyle, L.D. Pfefferle, E.E. Gulcicek, S.D. Colson, "Laser–driven Electron Ionization for a VUV Photoionization Time–Of–Flight Mass Spectrometer", (11) pp.; American Institute of Physics.

P.Y. Cheng and H.L. Dai, "A Photoemitted Electron–Impact Ionization Method For Time–Of–Flight Mass Spectrometers", pp. 2211–2214, American Institute of Physics.

U. Boesl et al. "Laser Ion Sources For Time–Of–Flight Mass Spectrometry", Int. J. Mass Spectrom. Ion Processes 131 (1994) 87–124.

* cited by examiner

ATMOSPHERIC PRESSURE PHOTOIONIZER FOR MASS SPECTROMETRY

CROSS REFERENCE TO RELATED APPLICATIONS

This application is a continuation in part of Application Ser. No. 09/247,646 filed on Feb. 9, 1999, now pending.

BACKGROUND OF THE INVENTION

1. Field of the Invention

The present invention relates to a monitor that can detect trace molecules from a sample. By way of example, the monitor may be a mass spectrometer.

2. Background Information

Mass spectrometers are typically used to detect one or more trace molecules from a sample. For example, a mass spectrometer can be used to detect the existence of toxic or otherwise dangerous compounds in a room. Mass spectrometers are also used to analyze drug compounds in solvents. Mass spectrometers typically ionize trace molecules from a gas sample and then deflect the ionized molecules into a detector. The detector may detect the mass of the ionized molecule by measuring the time required for the molecule to travel across a chamber or by other means. The identity of the molecule can then be determined from the mass.

U.S. Pat. No. 5,808,299 issued to Syage discloses a mass spectrometer that contains a photoionizer. The photoionizer includes a light source that can emit a light beam into a gas sample. The light beam has an energy that will ionize constituent molecules without creating an undesirable amount of fragmentation. The molecules are ionized at low pressures. Low pressure ionization is not as effective in detecting small concentrations of molecules.

U.S. Pat. No. 4,849,628 issued to McLuckey et al. ("McLuckey") discloses a mass detection system that can detect relatively low concentrations of a trace molecule. McLuckey utilizes a glow discharge ionizer that ionizes an "atmospheric" sample. Providing an air sample at atmospheric pressures increases the density of the sample and the number of ionized molecules. Increasing the number of ions improves the sensitivity of the detector. Although McLuckey uses the term atmospheric, ionization actually occurs in an ionization chamber having a pressure between 0.1 to 1.0 torr.

It is generally desirable to provide a mass spectrometer that can detect a number of different compounds; provides a strong molecular ion signal with minimal fragmentation; is not susceptible to interference and gives a linear response with concentration.

It would be desirable to provide a photoionizer that can handle large quantities of sample in order to use with various liquid flow sources such as liquid chromatography and separation columns. It would also be desirable to provide a photoionizer that ionizes analyte in liquid samples by a means other than thermal vaporization.

BRIEF SUMMARY OF THE INVENTION

One embodiment of the present invention is a monitor that can detect a trace molecule in a sample provided by an inlet at approximately one atmosphere. The trace molecule can be ionized by a photoionizer coupled to the inlet. The trace molecule can be detected by a detector.

DETAILED DESCRIPTION OF THE PREFERRED. EMBODIMENT

Disclosed is a monitor that can detect a trace molecule that is ionized at approximately one atmosphere. The molecule is ionized with a photoionizer and detected by a detector. The monitor may include a number of techniques to introduce a sample into the photbionizer at approximately one atmosphere. One technique includes creating an electrically charged spray that is directed into the ionizer. The photoionizer may include a plurality of light sources that each ionize the sample with a different radiation energy.

Photoionization methods at atmospheric pressure have been developed for gas chromatography detection as disclosed in U.S. Pat. No. 3,933,432 issued to Driscoll and for ion mobility spectrometry as disclosed in U.S. Pat. No. 5,338,931 issued to Sprangler et al. In neither application are the ion masses measured and, as such, the final ions formed are not known due to ion-molecule chemistry that can occur at atmospheric pressure. Furthermore the role of solvent in absorbing light, which affects ion intensities are not considered in these devices. Finally, these devices are usually limited to volatile compounds in the gas phase. The present invention minimizes ion-molecule chemistry, minimizes solvent absorption, and enables detection of-non-volatile compounds, such as drug compounds, that are dissolved in liquid samples.

Figure 1:
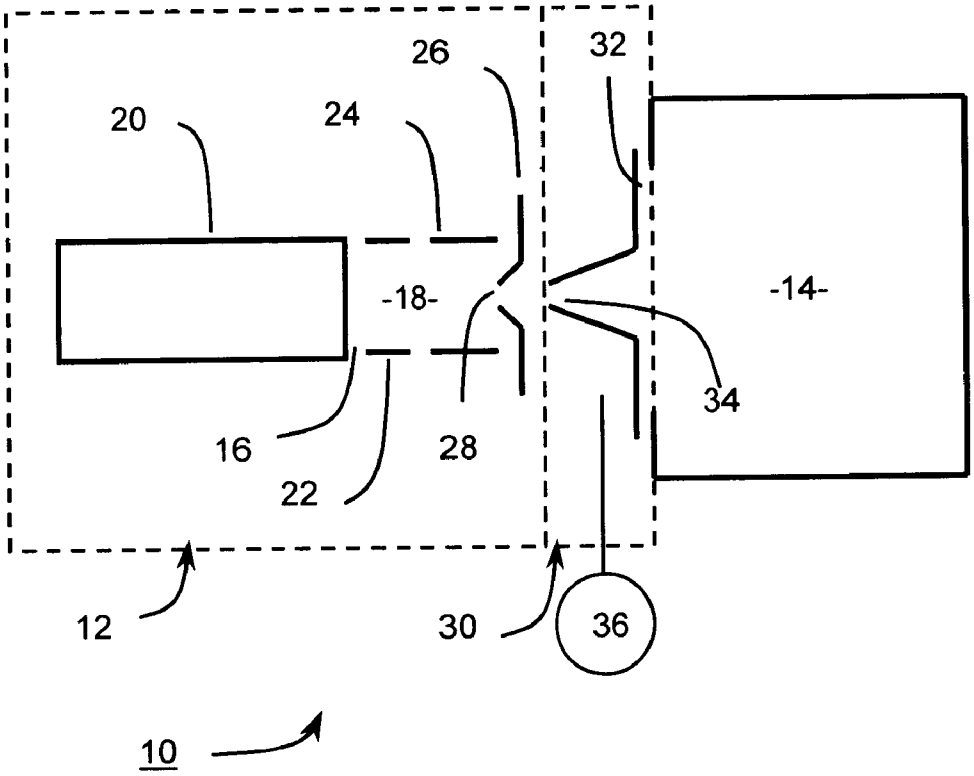
FIG. 1 is an illustration of an embodiment of a monitor of the present invention.

Referring to the drawings more particularly by reference numbers, FIG. 1 shows an embodiment of a monitor 10 of the present invention. The monitor 10 may include a photoionizer 12 that is coupled to a detector 14. By way of example, the detector 14 may be a mass detector. The photoionizer 12 may include an inlet 16 that allows a sample to flow into a ionization chamber 18. A light source 20 may direct a beam of light into the chamber 18 to ionize one or more trace molecules in the sample.

The light source 20 may emit light which has a wavelength so that photo-energy between 8.0 and 12.0 electron volts (eV) is delivered to the sample. Photo-energy between 8.0 and 12.0 is high enough to ionize most trace molecules without creating much molecular fragmentation within the sample. By way of example, the light source may be a Nd:YAG laser which emits light at a wavelength of 355 nanometers (nm). The 355 nm light may travel through a frequency tripling cell that generates light at 118 nms. 118 nm light has an energy of 10.5 eV. Such a light source is described in U.S. Pat. No. 5,808,299 issued to Syage, which is hereby incorporated by reference. Alternatively, the light source may include continuous or pulsed discharge lamps which are disclosed in U.S. Pat. No. 3,933,432 issued to Driscoll; U.S. Pat. No. 5,393,979 issued to Hsi; U.S. Pat. No. 5,338,931 issued to Spangler et al.; and U.S. Pat. 5,206,594 issued to Zipf, which are-hereby incorporated by reference.

The photoionizer 12 may have a first electrode 22, a second electrode 24 and a third electrode 26. The electrodes 22, 24 and 26 may have voltage potentials that direct the ionized molecules through an aperture 28 in the third electrode 26 and into a chamber 30.

The chamber 30 may include an electrode 32 that has a voltage potential, that in combination with the electrodes 22, 24 and 26 pull the ionized molecules through an aperture 34 in electrode 32 and into the detector 14. By way of example, the electrodes 22, 24, 26 and 32 may have voltage potentials of 50, 40, 20 and 10 volts, respectively.

The chamber 30 may be coupled to a pump 36. The intermediate chamber 30 and pump 36 can increase the throughput from the photoionizer 12. For example, the throughput from the photoionizer 12 in the monitor 10 of the present invention may be defined by the equation:

$$UO2=P1\times S1 \quad (1)$$

Where;

UO2=the throughput from the photoionizer

P1=the pressure within the chamber 30.

S1=the pumping speed of the pump 36.

This is to be contrasted with a throughput for a monitor 10 with no chamber 30 or pump 36. The throughput for a non-chamber system can be defined by the equation:

$$UO2=P2\times S2 \quad (2)$$

Where;

UO2=the throughput from the photoionzier.

P2=the pressure within the first region of the detector.

S2=the pumping speed of the pump (not shown) coupled to the detector.

As shown in Table I below, the inclusion of the chamber 30 and pump 36 can increase the throughput UO2 by 200 times. A gas throughput of UO2=10 torr L/s is equivalent to a value of about 800 atm $cm^3$/min. If the gas is a volatilized liquid such as methanol, then the liquid volume flow rate that can be sustained by the monitor 10 is about 1.6 ml/min. This calculation is based on 1 ml of liquid methanol volatilizing to about 500 $cm^3$ of vapor at about 200° C.

TABLE I

| | Chamber | No-Chamber |
|---|---|---|
| P1 | 1 torr | N/A |
| P2 | $10^{-3}$ torr | $10^{-3}$ torr |
| S1 | 10 L/s | N/A |
| S2 | 50 L/s | 50 L/s |

TABLE I-continued

| | Chamber | No-Chamber |
|---|---|---|
| U01 | 10 torr L/s | N/A |
| U12 | 0.05 torr L/s | N/A |
| U02 | 10 torr L/s | 0.05 torr L/s |
| V0 | 1 mL | 1 mL |
| P0 | 100–760 torr | 0.1–760 torr |
| T0 | 0.01–0.076 s | 0.002–15.2 s |

Additionally, the residence time of the sample within the chamber 18 can be defined by the equation:

$$TO=PO\times VO/UO2 \quad (3)$$

Where;

TO=the residence time.

PO=the pressure within the ionization chamber 18.

VO=the volume of the chamber 18.

UO1=is the throughput from the ionization chamber 18 into chamber 30.

U12=is the throughput from the chamber 30 to the detector 14.

UO2 is the throughput from the ionization chamber 18 to the detector 14.

Figure 2:
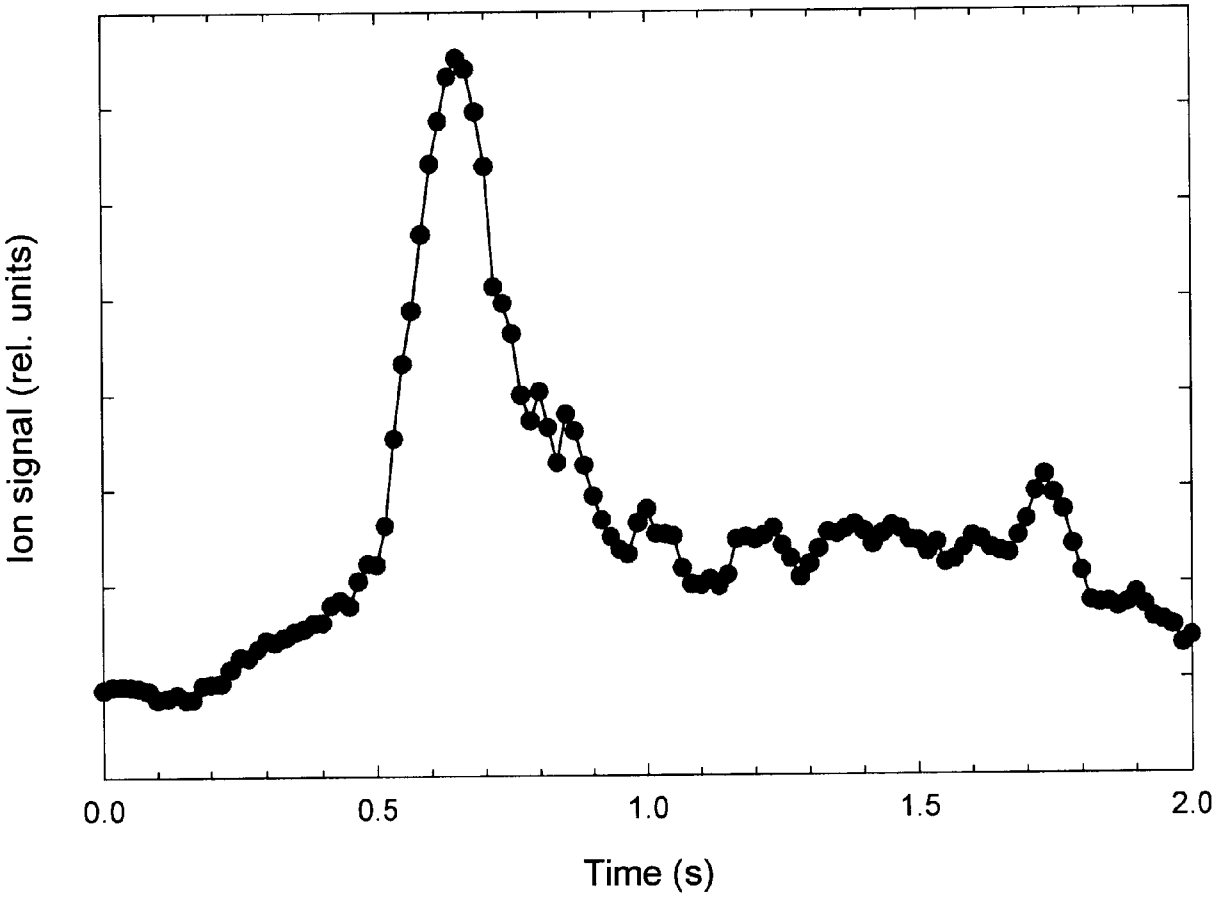
FIG. 2 is a graph showing an output of the monitor as a function of time, wherein a sample containing diisopropyl, methylphosphonate (DIMP) is introduced by a syringe and photbionized.
Figure 3:
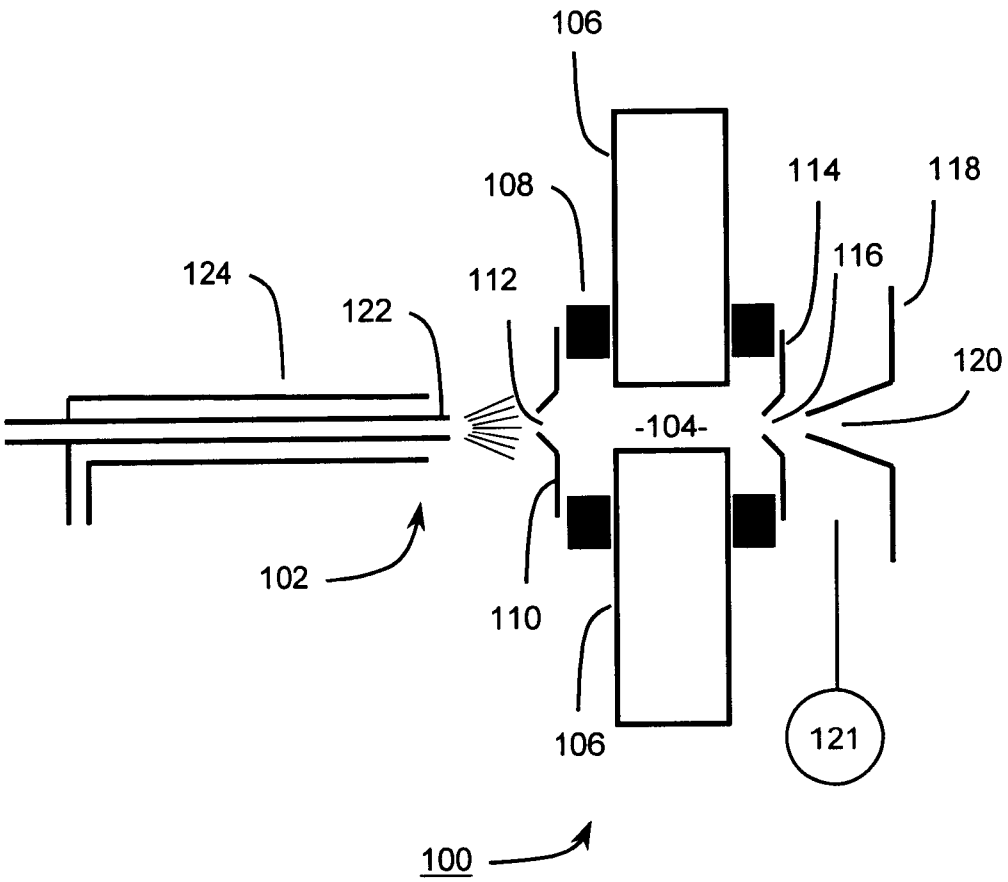
FIG. 3 is an illustration of a top view of an embodiment of a monitor.
Figure 4:
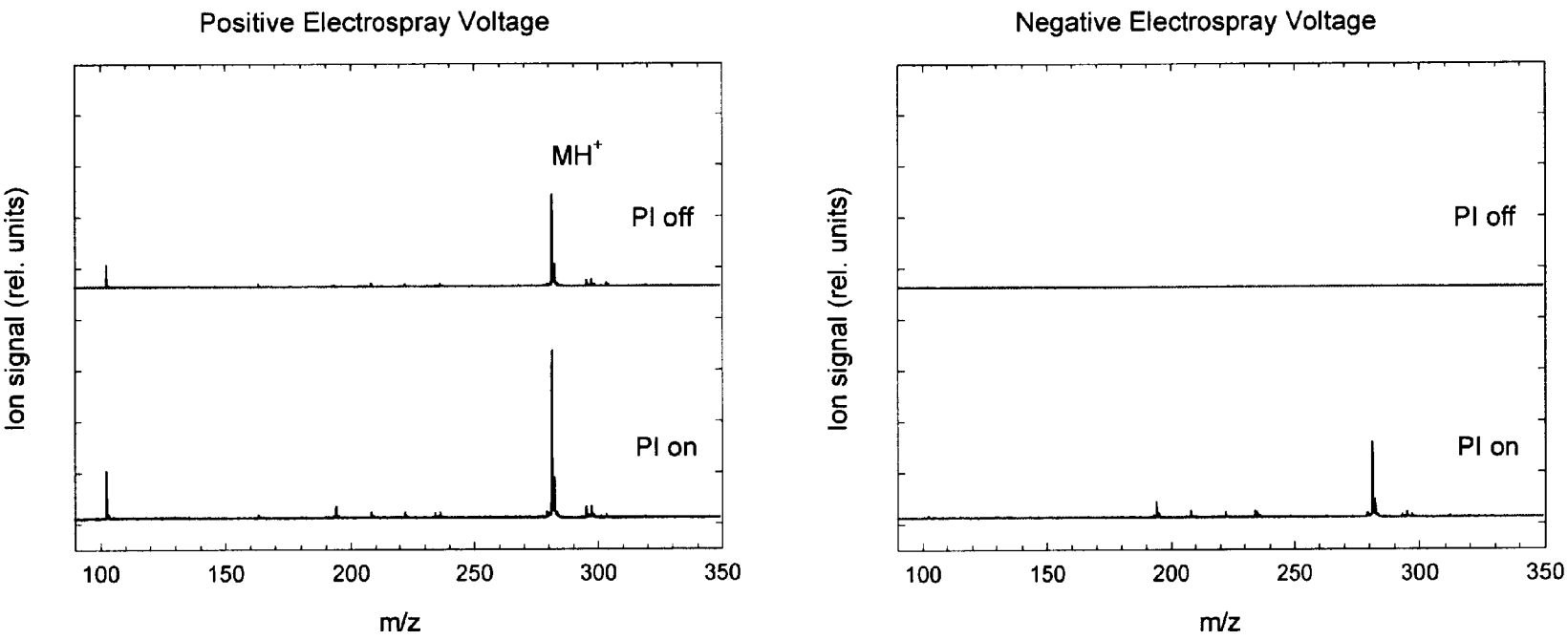
FIG. 4 is a graph showing the output of the monitor wherein a sample of imipramine in methanol is introduced by the spray source at positive and negative voltage and observed with the lamp on and off.

As shown by Table 1, the residence time TO for a sample at 760 torr is about 15 seconds for a monitor without a chamber 30 and pump 36, whereas with the present invention the residence time TO is about 0.1 seconds. FIG. 2 shows a fast response to a liquid sample injected into the chamber 18. The actual response time of the monitor is actually limited by the injection time, and not the residence time within the ionization chamber 18. FIGS. 3 and 4 show an embodiment of a photoionizer 100 that includes a inlet such as a liquid spray device 102 that can spray a sample into an ionization chamber 104. The photoionizer 100 may include a pair of light sources 106 that are mounted to a mounting block 108.

The photoionizer 100 may have a first electrode 110 with an aperture 112, a second electrode 114 with an aperture 116, and a third electrode 118 with an aperture 120. The electrodes 114 and 118 may have voltage potentials that guide ionized molecules out of the chamber 104. The photoionizer 100 is coupled to a detector (not shown) and may include an intermediate pump 121.

The liquid spray device 102 may include a tube 122 within a tube 124. The spray device 102 may be a nebulizer wherein the inner tube 122 contains a liquid sample and the outer tube 124 carries a gas flow that breaks the liquid into drops to create an aerosol that flows into the chamber 104. The liquid spray device 102 can also be a capillary without the gas sheath flow.

The diameters of the aperture 112 and 116 may be varied to adjust the pressure of the chamber 104. The aperture 112 can be made relatively large to allow a significant amount or all of the spray to enter the chamber 104. This mode may provide an ionization pressure of approximately 760 torr. This pressure can also be accomplished by placing the inner tube 122 within the aperture 112. If the tube 122 is sealed, the chamber 104 can operate at pressures higher than 760 torr.

It may be desirable to operate at lower pressures because too much solvent in the chamber 104 may absorb the radiation energy from the light sources 106. Additionally, less ion-molecule reactions occur at lower pressures. Also, the aperture 112 can lead to an enrichment of the desired higher molecular weight compounds in the liquid sample because solvent may evaporate off and the heavier compounds may stay on the spray centerline.

The inner tube 122 can be constructed from metal and operated as an electrospray tip by applying a high voltage potential between the tube 122 and the electrode 110. By way of example, the electrospray source can be of the ion spray type as disclosed in U.S. Pat. No. 4,861,988 issued to Henion et al. The voltage potential may be set low enough to avoid forming significant ionization of desired compounds dissolved in solvent, but high enough to charge the liquid droplets so that the droplets accelerate and evaporate without thermal heating.

The aerosol drops enter the ionization chamber 104 where the desired compounds are ionized in the gas phase or in the aerosol. The ionized molecules separate from the remaining aerosol under the influence of the voltage potentials of the electrodes 110, 114 and 118.

The voltage on the tube 122 can be adjusted to positive voltage relative to the electrode skimmer 112. Then positively charged aerosol droplets will be directed toward the ionizer region 104. If the voltage is raised to sufficiently high values, then electrospray ionization will result and positively charged electrospray ions will be observed in the mass spectrum. To minimize detection of these positively charged electrospray ions, the tube 122 may have a voltage that is negative relative to electrode skimmer 112. Then negatively charged aerosol droplets will be directed toward the ionizer region 104. Photoionization in region 104 will generate positively charged ions without the presence of positively charged electrospray ions. FIG. 4 shows photoionization mass spectra of a standard solution of imipramine-$d_6$ in methanol showing the positive and negative spray tip modes for the photoionization lamp on and off.

The photoionizer 100 can be operated in three different modes when the liquid spray is an electrospray device. The first mode is having ionization by both the liquid spray device 102 and the light sources 106. The second mode may be ionization with only the liquid spray device 102. The third mode may be ionization with only the light sources 106. These modes may be rapidly switched.

The photoionizer 100 can also have a discharge needle in region 104 in order to perform atmospheric pressure chemical ionization by prior art methods. This embodiment combined with photoionization gives a dual ionization capability that would make the ionization source applicable to a wider range of compounds. The photoionizer and the chemical ionizer may be operated independently or simultaneously.

Figure 5:
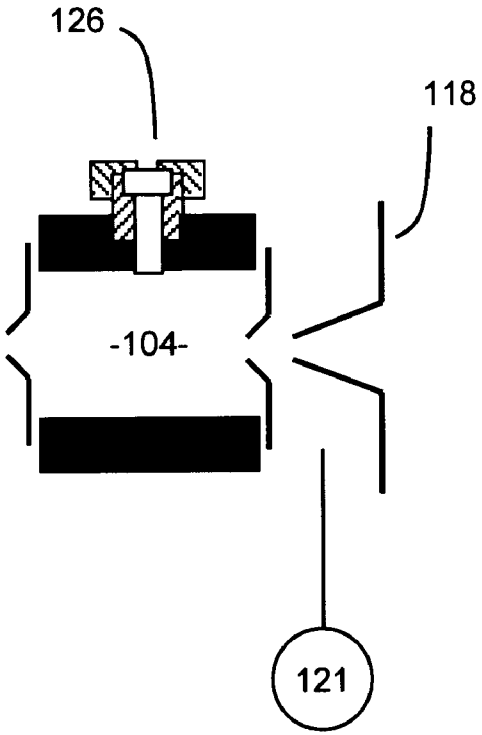
FIG. 5 is an illustration of a side view of the monitor shown in FIG. 3.
Figure 6:
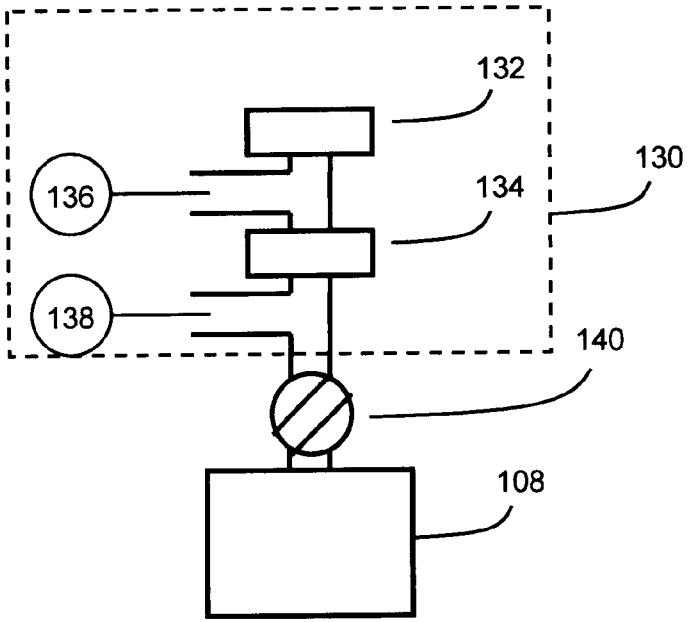
FIG. 6 is an illustration of a syringe sample delivery system for the monitor.

As shown in FIG. 5, the photoionizer 100 may include a syringe port 126 that allows a liquid sample to be injected into the chamber 104. FIG. 6 shows a specific embodiment of a syringe port 130 that has a pair of septa 132 and 134. The syringe port 130 may have a pump-out port 136 that maintains a low pressure between the septa 132 and 134. The syringe port 130 may also have a co-flow port 138 that introduces a flow of gas such as dry nitrogen, argon or helium, to smooth out the large pressure transient that occurs when a syringe is inserted through the septa 132 and 134. A ball valve 140 may be utilized to close off the port 130 and allow replacement of the septa 132 and 134.

Although two septa 132 and 134 are shown and described, it is to be understood that the syringe port 130 may have only one septum 132 or 134. A voltage may be applied to the syringe needle so that it may operate as an electrospray source. The co-flow port 138 may be configured as a tube to provide a nebulizing sheath flow to the electrospray needle.

Figure 8:
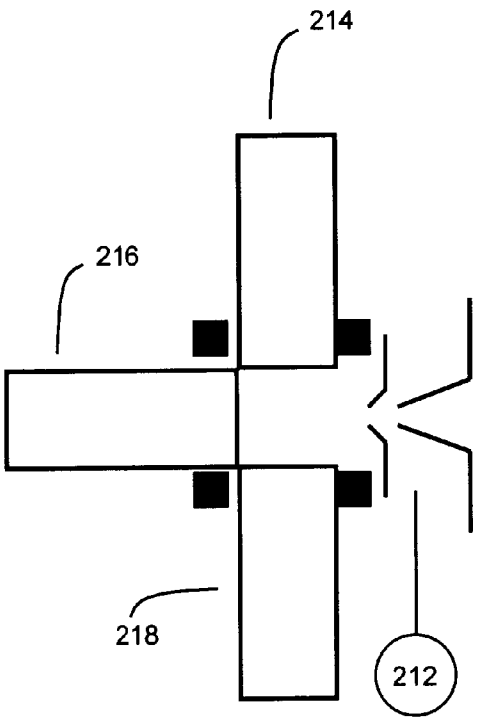
FIG. 8 is an illustration of a top view of the monitor shown in FIG. 7.
Figure 7:
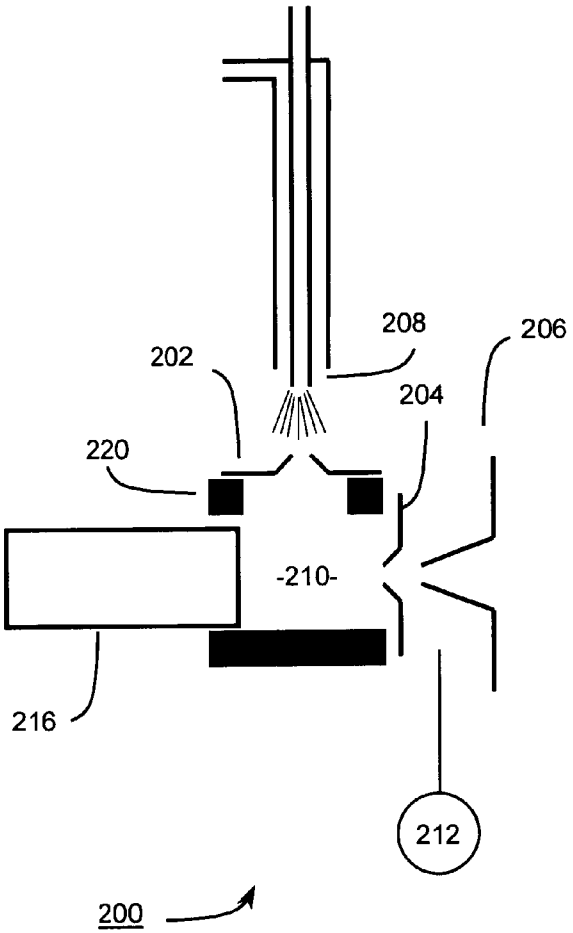
FIG. 7 is an illustration of a side view of an alternate embodiment of the monitor.

FIGS. 7 and 8 show another embodiment of a photoionizer 200 wherein the entrance electrode 202 is located at an angle from the exit electrodes 204 and 206. The photoionizer 200 may include a liquid spray device 208 that directs a sample into an ionization chamber 210. The photoionizer may be coupled to a detector (not shown) and an intermediate pump 212.

The photoionizer 200 may include three separate light sources 214, 216 and 218 mounted to a mounting block 220. Additional light sources may increase the ion molecule yield from the sample.

Figure 9:
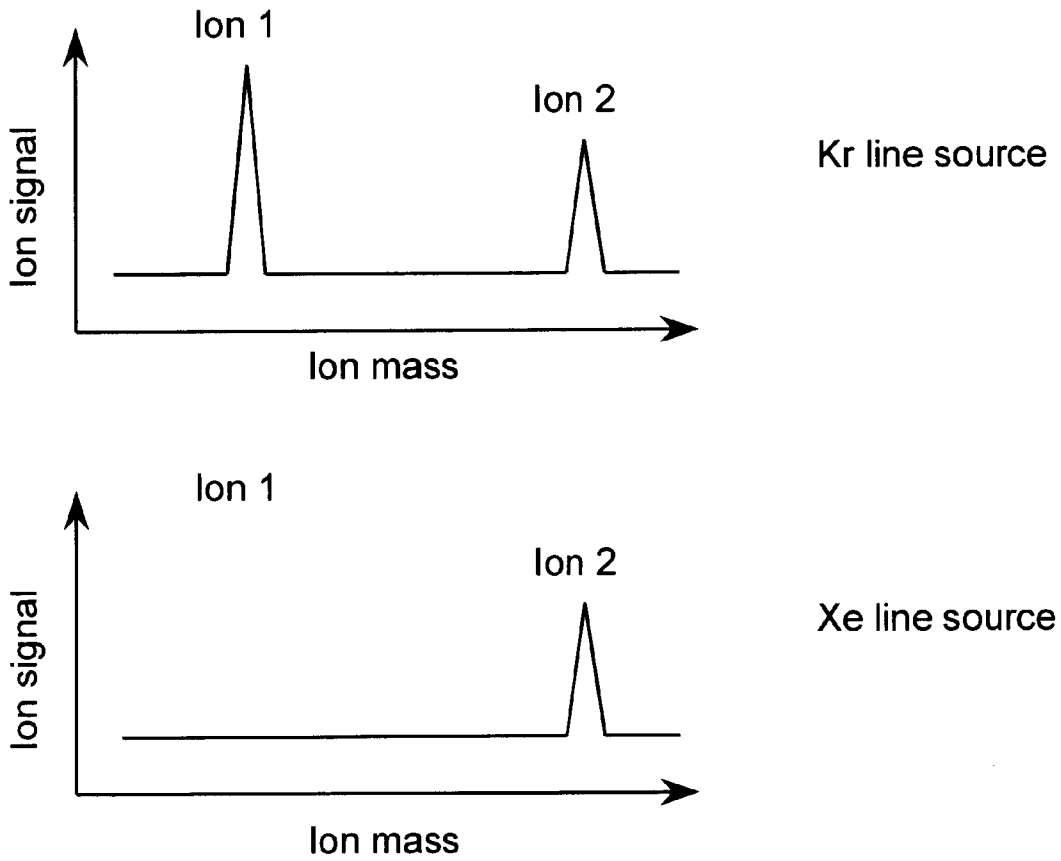
FIG. 9 is a graph showing an output of a monitor that utilizes multiple light sources each photoionizing a sample at a different energy.

The light sources 214, 216 and 218 may each have different radiation energies. For example, light source 214 may be a Krypton (Kr) line source that emits light having energy of 10.0 eV, the second light source 216 may be an Argon (Ar) source emitting light at an energy of 11.7 eV, and the third light source 218 may be a Xenon (Xe) light source emitting light at energy of 8.4 eV. Alternatively, one or more of the light sources 214, 16 and 218 may be an Xe arc lamp. As shown in FIG. 9, molecules that have ionization potentials between the energies of the light sources will be ionized by the Kr light source, but not the Xe light source.

Figure 10:
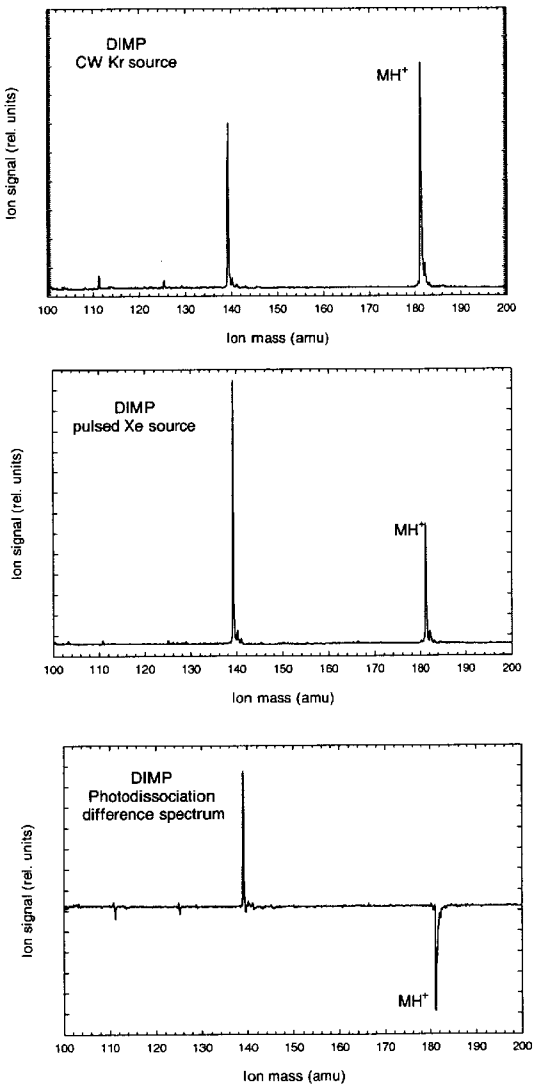
FIG. 10 are graphs showing an output of a monitor that utilizes a continuous photoionization source and a pulsed photoionization/dissociation source.

Each light source 214, 216 and/or 218 may emit a range of wavelengths at sufficient intensity to photodissociate the ions that are formed. By way of example, a pulsed Xe arc lamp emits high energy-radiation for ionization and also lower energy radiation that can be photoabsorbed by the ions causing them to dissociate to fragments. Controlled photofragmentation can be used as a method to obtain structure information on the molecule and also to determine if an existing ion is a fragment or a parent ion FIG. 10 shows a photoionization mass spectrum of DIMP using a continuous wave Kr lamp and then with a pulsed Xe arc lamp. In the former case, a molecular ion and a fragment ion are observed. In the-latter case, the fragment ion is greatly enhanced. By subtracting the first spectrum from the second spectrum, a difference spectrum is obtained that shows the depletion of the parent ion and the production of the fragment ion. The different lamps can be rapidly switched giving real-time difference spectra information. Difference spectra can also be recorded by switching the photoionization and electrospray ionization methods as described before.

The photoionizaton sources, such as those in FIGS. 3 and 7 have an inlet port near the lamp surface to introduce an inert gas to sweep past the lamp surface. Referring to FIG. 3, the sweep gas would pass across the surface of the light source 106 in order to keep condensable compounds from adsorbing on the light source surface and to keep the density of solvent molecules near the light source low so that light is not significantly absorbed by the solvent.

Figure 11:
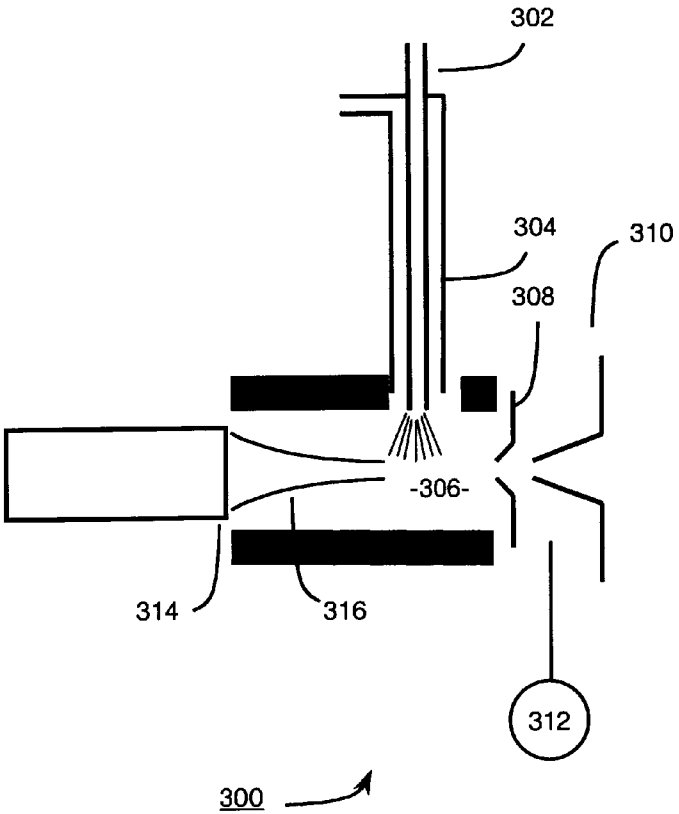
FIG. 11 is an illustration of an alternate embodiment of the monitor.

FIG. 11 shows another embodiment of a monitor 300. The monitor 300 may have a pair of tubes 302 and 304 that introduce a sample to a chamber 306. The monitor 300 may have electrodes 308 and 310 and a pump 312 to pull some of the molecules out of the chamber 306. The monitor 300 includes a light source 314 and a light guide 316 that directs light to an area adjacent to the outlet of the tubes 302 and 304. Byway of example, the light guide 316 may be an optical fiber or tappered hollow tube. A sweep gas may be introduced to the chamber to clean the light source 314 and light guide 316 and prevent high absorption by any solvent in the sample.

Figure 12:
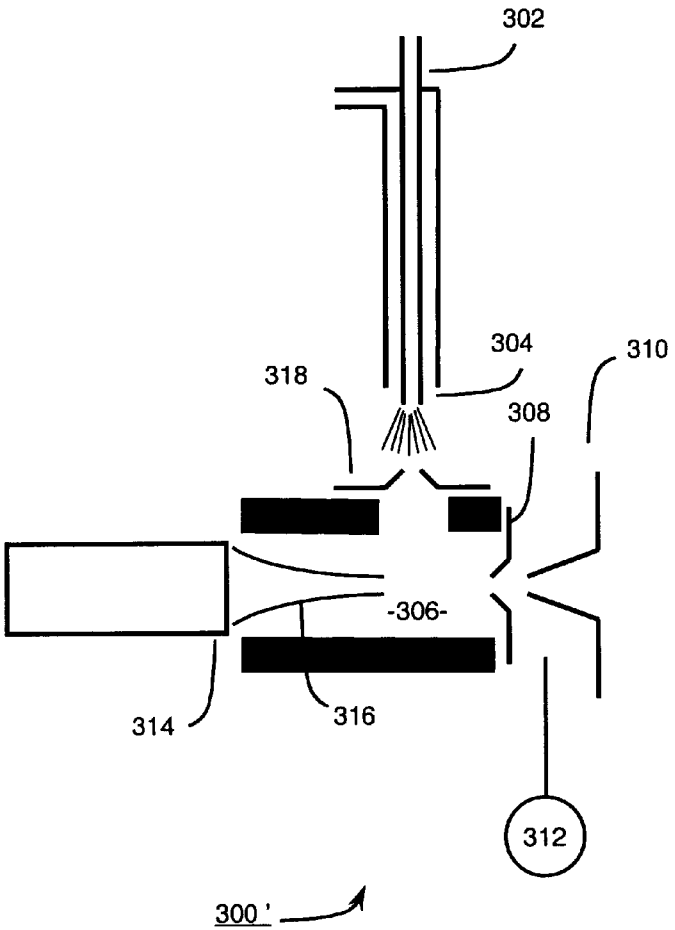
FIG. 12 is an illustration of an alternate embodiment of the monitor.

FIG. 12 shows another embodiment of a monitor 300' wherein the tubes 302 and 304 are located outside the chamber 306. The monitor 300' may have another electrode 318 that operates in the same manner as electrode 110 shown in FIG. 3.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A monitor that can detect trace molecules, comprising:

an electro-spray device that can provide a sample with the trace molecule;

a photoionizer that is coupled to said electro-spray device and can ionize a trace molecule;

a chemical ionizer that is coupled to said electro-spray device and can ionize a trace molecule; and, a detector that is coupled to said photoionizer and can detect the trace molecule.

2. The monitor of claim 1, further comprising a syringe port coupled to said-photoionizer.

3. The monitor of claim 1, wherein said photoionizer includes a plurality of light sources.

4. The monitor of claim 3, wherein said light sources emit light at different radiant energies.

5. The monitor of claim 4, wherein said light sources are switched to sequentially emit light.

6. The monitor of claim 1, further comprising a chamber located between said photoionizer and said detector and a pump coupled to said chamber.

7. The monitor of claim 1, wherein said detector is a mass detector.

8. A monitor that can detect a trace molecule, comprising:

an electro-spray device that can provide a sample containing the trace molecule;

a photoionizer that is coupled to said electro-spray device and can ionize the trace molecule; and, a detector that is coupled to said photoionizer and can detect the trace molecule.

9. The monitor of claim 8, wherein said inlet includes a liquid spray device.

10. The monitor of claim 8, wherein said inlet includes a syringe port.

11. The monitor of claim 9, further comprising a syringe port coupled to said photoionizer.

12. Thee monitor of claim 9, wherein said photoionizer includes a plurality of light sources.

13. The monitor of claim 12, wherein said light sources each emits light at a different radiant energy.

14. The monitor of claim 13, wherein said light sources are switched to sequentially emit light to ionize the trace molecules.

15. The monitor of claim 8, further comprising a chamber located between said photoionizer and said detector and a pump coupled to said chamber.

16. The monitor of claim 8, wherein said detector is a mass detector.

17. The monitor of claim 8, wherein said electro-spray device includes a first tube located within a second tube.

18. The monitor of claim 8, wherein the charge created by said electro-spray device is negative.

19. A method for detecting at least two trace molecules in a gas sample, comprising:

introducing a charged sample into an ionization chamber at approximately one atmosphere, wherein the sample includes a trace molecule;

photoionizing a first trace molecule;

chemical ionizing a second trace molecule; and detecting the ionized trace molecules.

20. The method of claim 19, wherein the trace molecule is photoionized.

21. The method of claim 20, wherein the trace molecule is photoionized by sequentially emitting a plurality of different light beams into the sample, each light beam having a different wavelength.

22. The method of claim 20, further comprising the step of passing a gas across a light source.

23. The method of claim 19, wherein at least a portion of the sample is negatively charged.

24. A method for detecting at least one trace molecule in a gas sample, comprising:

introducing a charged sample into an ionization chamber, wherein the charged sample includes a trace molecule;

photoionizing the trace molecule with a light source;

detecting the ionized trace molecule; and, passing a gas across the light source.

25. The method of claim 24, wherein the trace molecule is photoionized by sequentially emitting a plurality of different light beams into the sample, each light beam having a different wavelength.

26. The method of claim 24, wherein at least a portion of the sample is negatively charged.

27. A method for detecting at least one trace molecule in a fluid sample, comprising:

spraying a charged liquid sample into an ionization chamber, wherein the liquid sample includes a trace molecule;

photoionizing the trace molecule; and, detecting the ionized trace molecule.

28. The method of claim 27, wherein the trace molecule is photoionized by sequentially emitting a plurality of different light beams into the sample, each light beam having a different wavelength.

29. The method of claim 27, further comprising the step of passing a gas across a light source.

30. The method of claim 27, wherein at least a portion of the sample is negatively charged.

* * * * *